US005415480A

United States Patent [19]

Kikugawa

[11] Patent Number: 5,415,480

[45] Date of Patent: May 16, 1995

[54] PRINTER HAVING A STEPPING MOTOR FOR DRIVING AND RETAINING A TYPE WHEEL

[75] Inventor: Noriyuki Kikugawa, Yokohama, Japan

[73] Assignee: Canon Kabushiki Kaisha, Tokyo, Japan

[21] Appl. No.: 266,449

[22] Filed: Jun. 28, 1994

Related U.S. Application Data

[63] Continuation of Ser. No. 912,589, Jul. 13, 1992, abandoned, which is a continuation of Ser. No. 739,723, Jul. 30, 1991, abandoned, which is a continuation of Ser. No. 449,404, Dec. 19, 1989, abandoned, which is a continuation of Ser. No. 157,143, Feb. 10, 1988, abandoned, which is a continuation of Ser. No. 851,294, Apr. 4, 1986, abandoned, which is a continuation of Ser. No. 577,985, Feb. 8, 1984, abandoned.

[30] Foreign Application Priority Data

Feb. 23, 1983 [JP] Japan ..... 58-27638

[51] Int. Cl.[6] ..... B41J 5/30

[52] U.S. Cl. ..... 400/144.2; 318/696; 400/163

[58] Field of Search ..... 400/144.2, 144.3, 154.5, 400/163, 902, 903; 318/362, 375, 448, 611, 612, 696, 757

[56] References Cited

U.S. PATENT DOCUMENTS

| | | | |
|---|---|---|---|
| 3,954,163 | 5/1976 | Gabor | 400/144.2 |
| 4,019,110 | 4/1977 | Gerry | 400/144.2 |
| 4,242,624 | 12/1980 | Schalk | 318/696 |
| 4,258,622 | 3/1981 | Estraband et al. | 400/154.5 |
| 4,293,233 | 10/1981 | Hoffman | 400/144.2 |
| 4,329,635 | 5/1982 | Reilly | 318/696 |
| 4,353,019 | 10/1982 | Sweeney, Jr. | 318/611 |
| 4,353,021 | 10/1982 | Watanabe et al. | 318/696 |
| 4,417,189 | 11/1983 | Overfield | 318/696 |
| 4,429,268 | 1/1984 | Yajima et al. | 318/696 |
| 4,438,379 | 3/1984 | Chiang et al. | 318/696 |
| 4,464,071 | 8/1984 | Sakakibara | 318/696 |
| 4,479,723 | 10/1984 | Shida | 368/157 |
| 4,484,124 | 11/1984 | White | 318/696 |
| 4,550,279 | 10/1985 | Klein | 368/157 |
| 4,556,836 | 12/1985 | Antognini | 368/157 |
| 4,746,847 | 5/1988 | Kikugawa | 318/696 |

FOREIGN PATENT DOCUMENTS

| | | | |
|---|---|---|---|
| 0068802 | 1/1983 | European Pat. Off. . | |
| 1555056 | 1/1969 | France | 318/696 |
| 2742932 | 12/1979 | Germany . | |
| 3321561 | 12/1984 | Germany . | |

*Primary Examiner*—David A. Wiecking
*Attorney, Agent, or Firm*—Fitzpatrick, Cella, Harper & Scinto

[57] ABSTRACT

In a printer which selects a character by moving a type wheel by a stepping motor, phases other than a stable phase of windings of the stepping motor are shorted when a rotor of the stepping motor comes to a vicinity of a stable point of a target phase, and an exciting time of the stable phase is gradually extended. The primary drive signal is turned off during energization of a retaining signal and during hammer energization.

8 Claims, 5 Drawing Sheets

PRINTER HAVING A STEPPING MOTOR FOR DRIVING AND RETAINING A TYPE WHEEL

This application is a continuation of application Ser. No. 07/912,589, filed Jul. 13, 1992, now abandoned, which is a continuation of application Ser. No. 07/739,723, filed Jul. 30, 1991, now abandoned, which is a continuation of application Ser. No. 07/449,404, filed Dec. 19, 1989, now abandoned, which is a continuation of application Ser. No. 07/157,143, filed Feb. 10, 1988, now abandoned, which is a continuation of application Ser. No. 06/851,294, filed Apr. 4, 1986, now abandoned, which is a continuation of application Ser. No. 06/577,985, filed Feb. 8, 1984, now abandoned.

BACKGROUND OF THE INVENTION

1. Field of the Invention

The present invention relates to a printer, and more particularly to a printer which selects a character by moving a type wheel by a stepping motor.

2. Description of the Prior Art

In a prior art printer of this type, when the stepping motor is to be shifted from one stable state to another stable state, an attenuating vibration occurs in the vicinity of the target stable point. Therefore, the waiting time to absorb the vibration, that is, the damping time must be sufficiently large.

As a result, when the character is to be selected by the stepping motor, the operation time is long and hence the printing time is long.

In order to resolve the above problem, where high speed operation is required, a system has been proposed in which a position detector is provided to detect a current position of the type wheel, which is fed back to the stepping motor to effect closed loop control.

However, such a system needs additional components and a complex control circuit and hence cost increases.

SUMMARY OF THE INVENTION

It is an object of the present invention to provide an inexpensive printer which can reduce character selection time without utilizing closed loop control.

BRIEF DESCRIPTION OF THE DRAWINGS

FIGS. 1–5 show one embodiment of the present invention, in which

FIG. 1 is a perspective view of a printer,

FIG. 2 is a block diagram showing a basic configuration of a control circuit,

FIG. 3 is a block diagram showing a detail of the control circuit,

FIG. 4 shows a circuit diagram of a stepping motor drive circuit,

DETAILED DESCRIPTION OF THE PREFERRED EMBODIMENTS

Figure 1:
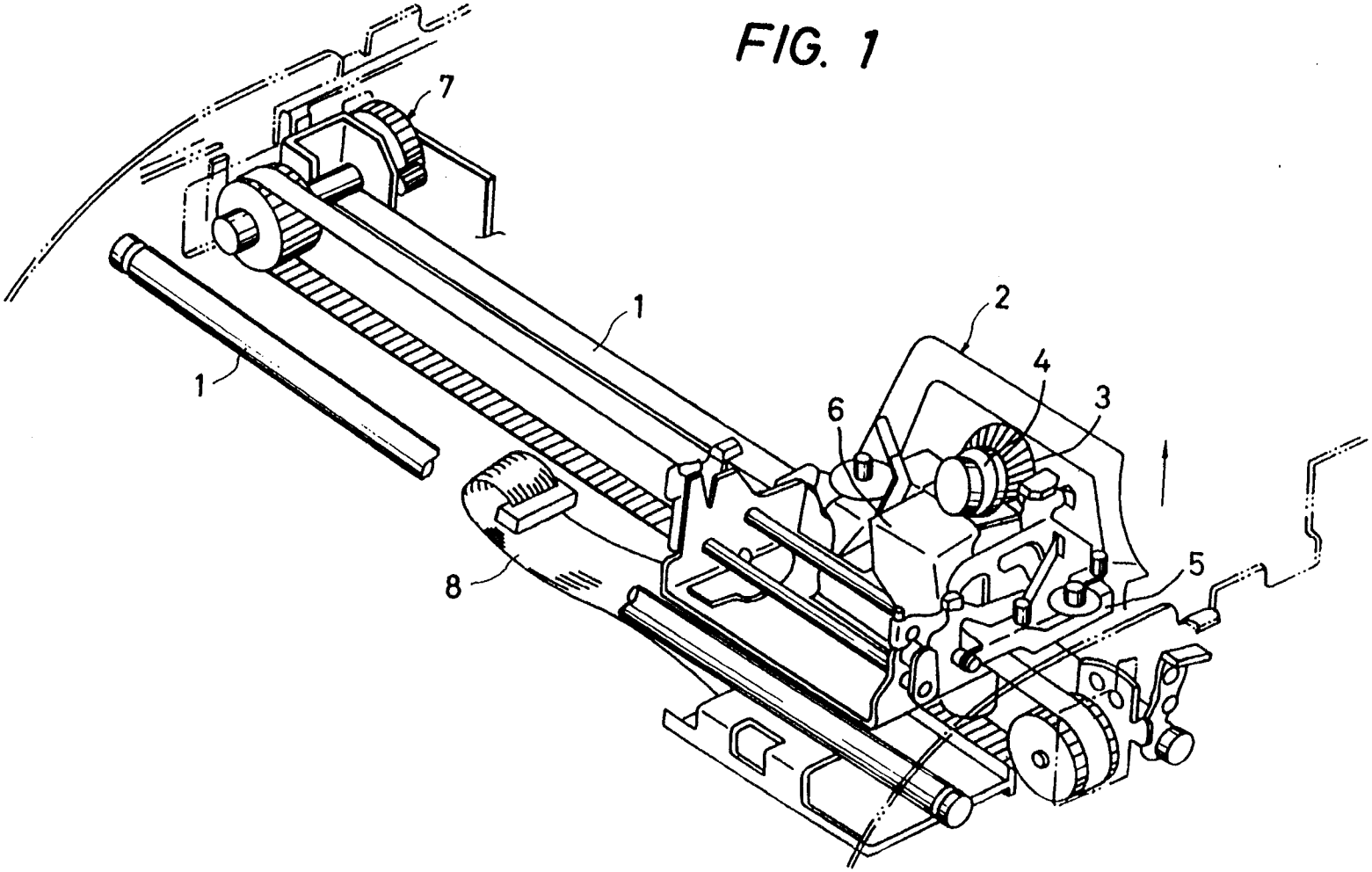

FIG. 1 shows a printer having a daisy type wheel in accordance with the present invention. The printer has a carriage 2 which is slidably guided by guide bars 1. A daisy type wheel 3 is a mounted on the carriage 2 and can be struck by a hammer 4.

A ribbon shift mechanism 5 for positioning an ink ribbon and an erasing ribbon, not shown, to a print position is arranged at one end of the carriage 2.

The type wheel 3 is rotated by a stepping motor 6. The carriage 2 is driven by a carriage drive mechanism 7, having a belt and a pulley in parallel to a platen (not shown) one character pitch or a plurality of spaces at a time. Numeral 8 denotes a flexible printed circuit board which follows the movement of the carriage 2 and supplies a power supply voltage and control signals thereto.

Figure 2:
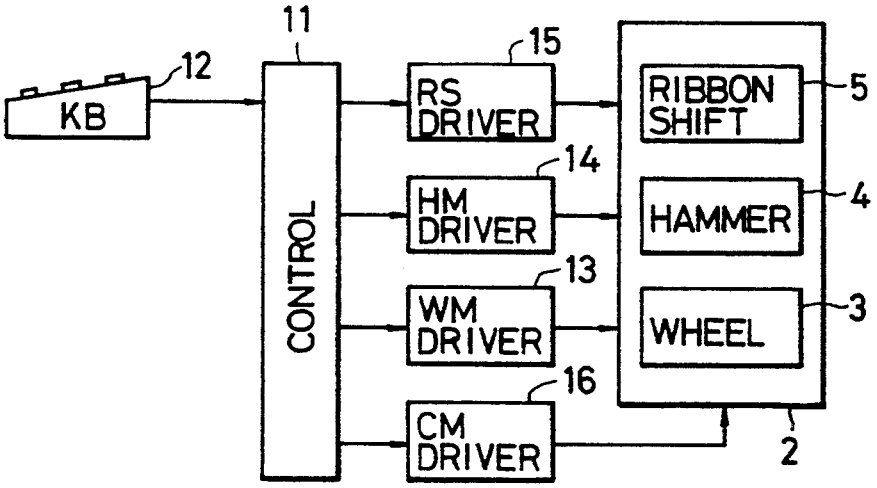

FIG. 2 shows a block diagram of a control circuit. Numeral 11 denotes a controller to which a keyboard 12 is connected.

By depressing keys arranged on the keyboard 12, signals are supplied to the controller 11 which in turn controls the type wheel 3, the print hammer 4, the ribbon shift mechanism 5 and the carriage 2 through a WM driver 13 for the type wheel driving stepping motor, a HM driver 14 for the print hammer, a RS driver 15 for shifting the ribbon and a CM driver 16 for the carriage driving stepping motor.

Figure 3:
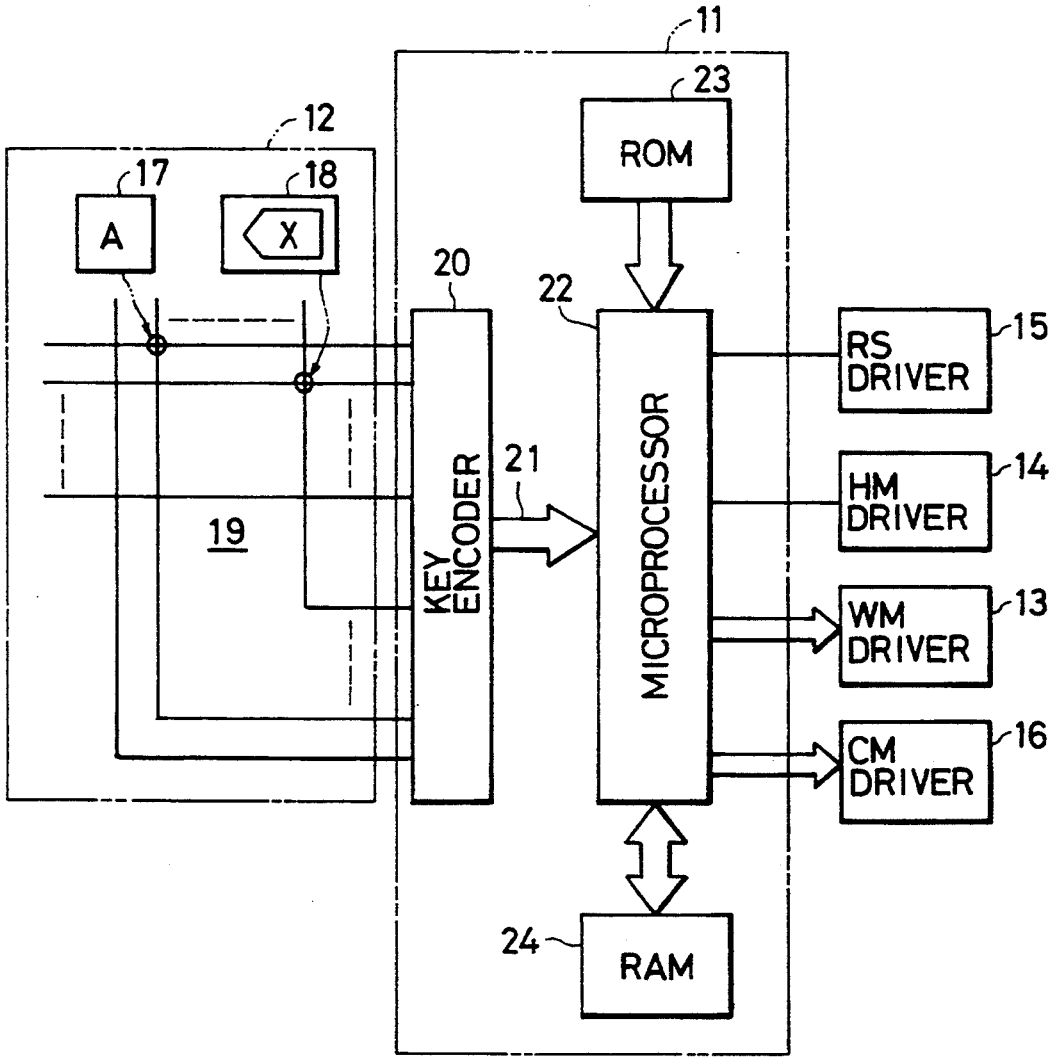

FIG. 3 shows a detail of the control circuit.

Keys 17 and 18 are arranged on the keyboard 12. The key 17 is, for example, a key for printing a character "A" and the key 18 is an erasing key for designating the erasure of a printed character.

The depression of the key is detected by a key matrix 19 which is connected to a key encoder 20. The key encoder 20 is connected to a micro processor 22 through a data bus 21.

The microprocessor 22 comprises a processor for processing information, registers for storing numeric data, an adder for carrying out an arithmetic operation and a controller.

A ROM (read-only memory) 23 for storing microinstruction information for sequential control and a RAM (random access memory) which is used as a line buffer and a working memory are externally connected to the microprocessor 22.

The microprocessor 22 has output ports through which control signals are supplied to the ribbon shift driver 15, the print hammer driver 14, the type wheel driving stepping motor driver 13 and the carriage driving stepping motor driver 16.

Figure 4:
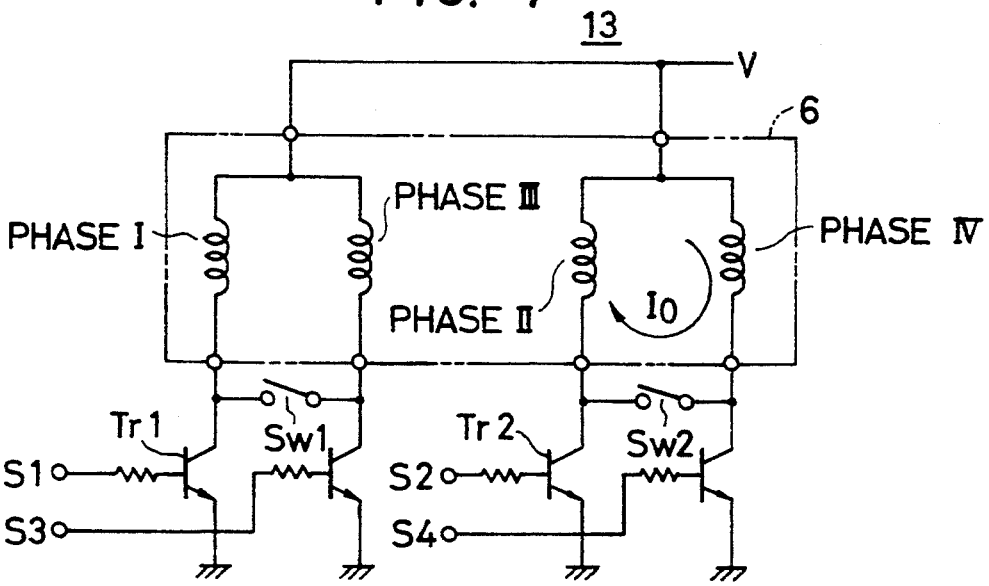

FIG. 4 shows a detail of the head driving stepping motor driver. A block circled by a broken line shows a 4-phase unipolar winding stepping motor 6. S1–S4 denote phase signals supplied from signal lines connected to the output ports of the microprocessor 22. They are supplied to transistors Tr1–Tr4 which drive respective phases.

Switches SW1 and SW2 are closed in a vicinity of a stable point of a rotor to reduce a damping time. They are controlled by the microprocessor 22.

In a print operation, one of phases I–IV is excited to drive the type wheel by a one-phase drive system.

Each character corresponds to one of the phases I–IV of the stepping motor. For example, the character "A" corresponds to the phase III.

The procedure of the normal print operation is now explained with reference to FIGS. 5A and 5B.

When the character key, for example, the key "A" on the keyboard 12 is depressed, the position of the key 17 is detected by the key matrix 19. The position is converted to an electrical signal by the key encoder 20 and it is supplied to the microprocessor 22 through a data bus 21.

The microprocessor 22 calculates the direction of rotation and the angle of rotation of the type wheel (the number of steps of the stepping motor) from the current position of the print head, for example, the position of the type "B" to the position of the type "A".

Assuming that the type "B" corresponds to the phase I of the stepping motor and the type "A" corresponds to the phase III, two steps away therefrom, the microprocessor 22 determines a velocity profile to drive the stepping motor 6 by referring the ROM 23 and produces the phase signals S1–S4.

The transistors Tr1–Tr4 are rendered conductive in accordance with the signals S1–S4 so that the phases I–IV are driven to select the type "A".

Figure 5A:
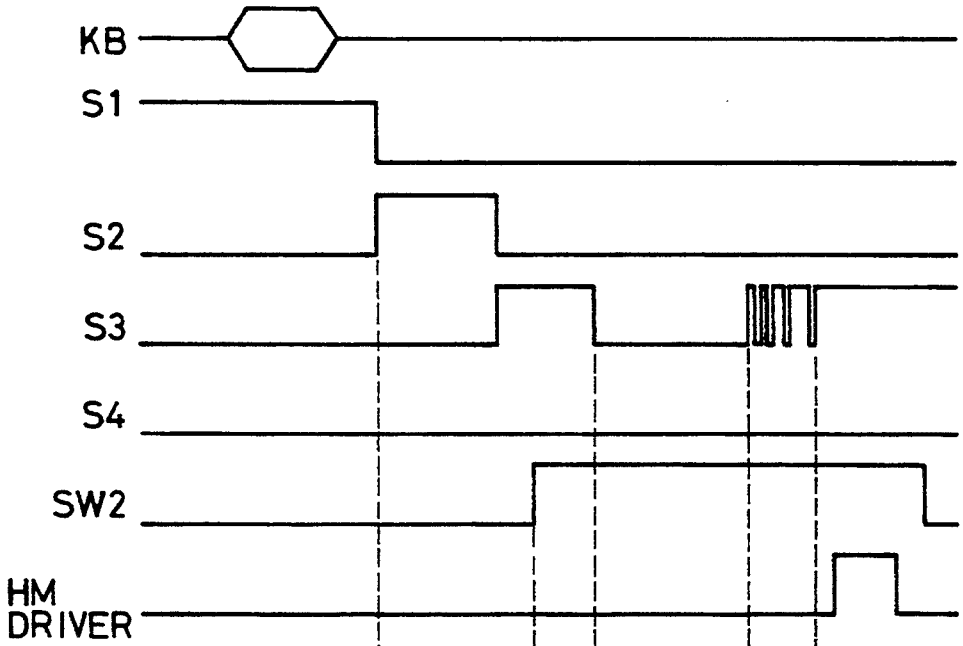
FIGS. 5A and 5B are a timing chart and a diagram for illustrating an operation of a rotor.

As shown in FIG. 5A, the phase signal S1 is turned off and the phase signal S2 is turned on, and when the phase signal S2 is then turned off, the phase signal S3 is turned on and the rotor is shifted by two phases to select the type "A".

The operation of the rotor is explained with reference to FIG. 5B. From a time $t_0$ at which the phase signal S1 is turned off to a time $t_1$, the operation is similar to that of the one-phase excitation but the switch SW2 is closed at the time $t_1$ to reduce the damping. At a time $t_2$ at which the phase signal S3 for exciting the phase III is turned off, counter electromotive forces are created in the windings of the phases II–IV to reduce the loop current $I_0$ and the rotor is moved toward the previous phase to attenuate the oscillation. The motor is completely stopped by a time $t_3$.

Figure 5B:
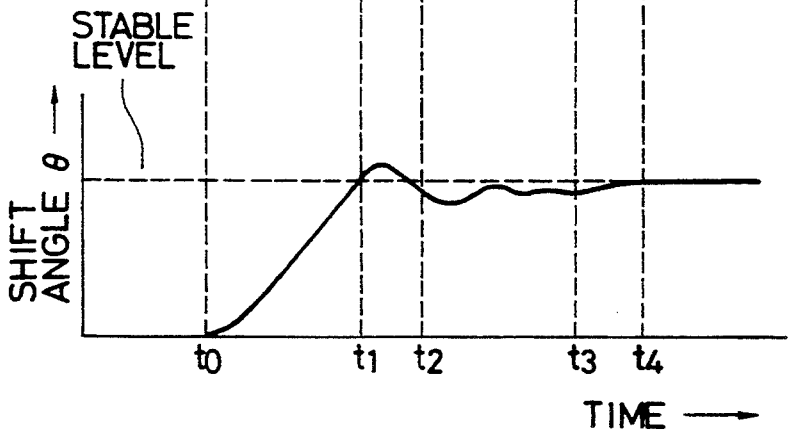

Since the phase III which is the current stable phase is not being driven at the time $t_3$, the stepping motor 6 is usually stopped at a point slightly deviated from the stable point as seen from FIG. 5B and a direction of deviation is not uniquely defined.

Thus, the phase III is driven. In this case, if the phase signal line S3 is simply energized, the rotor is moved to the inherent stable point and the oscillation occurs.

Thus, in accordance with the present invention, the exciting time to the phase III is gradually increased during a period from the time $t_3$ to a time $t_4$ to gradually increase a magnetic force so that the rotor is moved to the inherent stable point without oscillation.

After the character has been selected in this manner, the microprocessor 22 drives the hammer driver 14 in accordance with the impression information for the character to be printed to print the selected character with an impression force determined by the selected character. The output signal of the hammer driver 14 is shown by HM DRIVER in FIG. 5A.

In this manner, the normal print operation is carried out.

In the above embodiment, the switches SW1 and SW2 are provided to reduce the damping of the stepping motor 6. Alternatively, the phases I and III may be excited instead of turning on the switch SW1 and the phases II and IV may be excited instead of turning on the switch SW2.

Figure 6:
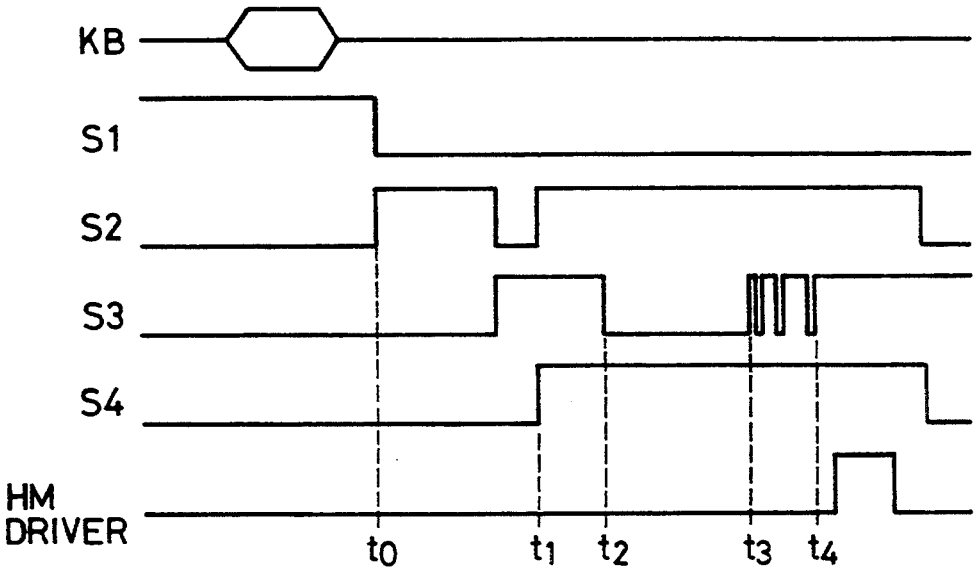
FIG. 6 shows a timing chart of another embodiment of the present invention.

A timing chart therefor is shown in FIG. 6, in which the phases II and IV are concurrently excited.

In the above embodiment, the motor for selecting the character is the 4-phase unipolar winding stepping motor which is one-phase excited. Alternatively, the stepping motor may be other than 4-phase motor having bipolor windings which is multi-phase excited.

As described hereinabove, according to the present invention, counter electromotive forces are generated in the windings of the stepping motor which selects the character and the exciting time for the predetermined phase is gradually increased or decreased to reduce the time to reach the stable point. Accordingly, the printer which has a short character selection time because of the open loop control and is simple in construction and inexpensive is provided.

What I claim is:

1. A printer comprising:

input means for inputting a character to be printed;

a stepping motor having a plurality of coils and which may be energized in a plurality of phases each corresponding to one said coil for driving a type wheel including a plurality of type elements to position any one of the type elements at a target position for printing, each of the phases being respectively allotted to one of the type elements of the type wheel;

arithmetic operation means for calculating the target position based on the character to be printed to drive said stepping motor;

means responsive to selection of a type element by said arithmetic operation means for producing a primary drive signal to sequentially energize the phases of said motor until the phase allotted to the selected type element is energized;

energizing means for applying a retaining signal to the phase allotted to the selected type element, the signal having a signal form that increases gradually in comparison to the primary drive signal; and means for applying a counter electromotive force to the adjacent phases of the allotted phase of said stepping motor during the time period encompassing the energization of the allotted phase of said primary drive signal, the turning off of the primary drive signal when the selected type element reaches the vicinity of the target position, and the time period encompassing the energizing of the retaining signal.

2. A printer according to claim 1, wherein said energizing means applies said secondary drive signal as a plurality of pulses.

3. A printer according to claim 2, wherein said energizing means applies said secondary drive signal as a plurality of pulses having pulse widths that increase as a function of time.

4. A printer according to claim 1, further comprising processing means for calculating the current position of the type element whose target position as calculated by said arithmetic operation means.

5. A printer according to claim 4, wherein said energizing means rotates said stepping motor by simultaneously energizing a plurality of phases of said stepping motor.

6. A stepping motor and damping apparatus for driving and positioning a member, said apparatus comprising:

a stepping motor which may be energized in a plurality of phases for driving the member;

means connected to said stepping motor for producing, based on a profile stored in a memory, a primary drive signal for sequentially energizing said phases of said motor until a predetermined phase is energized;

means, connected to said stepping motor, for applying a retaining signal to said predetermined phase to retain the stepping motor at a target position, the retaining signal being a gradually increasing signal; and means connected to said stepping motor and said producing means for applying a counter electromotive force to an adjacent phase of the stepping motor during the time period encompassing the energizing of said phases of said motor by said primary drive signal, during turning off of the primary drive signal after the predetermined phase has been energized, and during the time period encompassing the applying of the retaining signal to the predetermined phase, to damp the stepping motor.

7. A printer comprising:

a type wheel provided with a plurality of types elements;

a hammer adapted to hit a type element of the type wheel;

a stepping motor having a plurality of driving phases for rotating said type wheel;

first control means, coupled to said stepping motor, for supplying a first, main driving signal to said stepping motor to sequentially drive a predetermined phase of said stepping motor;

second control means, coupled to said stepping motor, for damping said stepping motor according to turning off of the main driving signal of the predetermined phase;

counter electromotive force controlling means for supplying a counter electromotive force to a phase different from the predetermined phase during the time period the first, main driving signal is supplied by said first control means and during the time the second control means turns off the main driving signal;

means, coupled to said stepping motor, for supplying a second driving signal to said stepping motor, the width of which is gradually changed after reducing an overdamping of said stepping motor; and third control means for driving said hammer to hit a type element of said type wheel after supplying the second driving signal to said stepping motor, wherein said counter electromotive force controlling means supplies the counter electromotive force to a phase different from the predetermined phase during the time period encompassing the supplying of the second driving signal to said stepping motor.

8. A printer comprising:

a type wheel provided with a plurality of types elements;

a hammer adapted to hit a type element of the type wheel;

a stepping motor having a plurality of driving phases for rotating said type wheel;

first control means, coupled to said stepping motor, for supplying a first, main driving signal to said stepping motor to sequentially drive a predetermined phase of said stepping motor;

second control means, coupled to said stepping motor, for damping said stepping motor according to turning off of the main driving signal of the predetermined phase;

counter electromotive force controlling means for supplying a counter electromotive force to a phase different from the predetermined phase during the time period the first, main driving signal is supplied by said first control means and during the time the second control means turns off the main driving signal;

means, coupled to said stepping motor, for supplying a second driving signal to said stepping motor, the width of which is gradually changed after reducing an overdamping of said stepping motor; and third control means for driving said hammer to hit a type element of said type wheel after supplying the second driving signal to said stepping motor, wherein said counter electromotive force controlling means supplies the counter electromotive force to a phase different from the predetermined phase during the time period encompassing the supplying of the second driving signal to said stepping motor, and during the driving of the hammer by said third control means.

* * * * *

UNITED STATES PATENT AND TRADEMARK OFFICE

CERTIFICATE OF CORRECTION

PATENT NO. : 5,415,480

DATED : May 16, 1995

INVENTOR(S) : NORIYUKI KIKUGAWA

It is certified that error appears in the above-indentified patent and that said Letters Patent is hereby corrected as shown below:

COLUMN 2

Line 6, "pulley" should read --pulley,--.

COLUMN 4

Line 48, "as" should read --is--.

Signed and Sealed this

Eighth Day of August, 1995

Bruce Lehman

*Attest:*

BRUCE LEHMAN

*Attesting Officer*

*Commissioner of Patents and Trademarks*